US010780466B2

(12) United States Patent
Janssen et al.

(10) Patent No.: US 10,780,466 B2
(45) **Date of Patent: *Sep. 22, 2020**

(54) METHOD AND DEVICE FOR BIOFOULING PREVENTION ON VESSELS BY MEANS OF UV RADIATION AND SURFACE MODIFICATION

(71) Applicant: KONINKLIJKE PHILIPS N.V., Eindhoven (NL)

(72) Inventors: Esther Anna Wilhelmina Gerarda Janssen, Waalre (NL); Roelant Boudewijn Hietbrink, Utrecht (NL); Bart Andre Salters, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 294 days.

This patent is subject to a terminal disclaimer.

(21) Appl. No.: 15/578,264

(22) PCT Filed: May 24, 2016

(86) PCT No.: PCT/EP2016/061641

§ 371 (c)(1),
(2) Date: Nov. 30, 2017

(87) PCT Pub. No.: WO2016/193055

PCT Pub. Date: Dec. 8, 2016

(65) Prior Publication Data

US 2018/0154405 A1 Jun. 7, 2018

(30) Foreign Application Priority Data

Jun. 4, 2015 (EP) ..... 15170650

(51) Int. Cl.
*B08B 7/00* (2006.01)
*B08B 17/02* (2006.01)
(Continued)

(52) U.S. Cl.
CPC ..... *B08B 7/0057* (2013.01); *B08B 17/00* (2013.01); *B08B 17/02* (2013.01); *B08B 17/04* (2013.01); *E02B 17/0017* (2013.01); *B63B 59/04* (2013.01)

(58) Field of Classification Search
CPC ..... B63B 59/04; B63B 59/08; A61L 12/10; B01J 19/123; B08B 17/02; C02F 1/325; C02F 2303/20
(Continued)

(56) References Cited

U.S. PATENT DOCUMENTS 5,308,505 A 5/1994 Titus et al.
5,322,569 A * 6/1994 Titus ..... A61L 2/0011 134/1
(Continued)

FOREIGN PATENT DOCUMENTS

JP 5675290 A 6/1981
WO 2008025538 A1 3/2008
(Continued)

*Primary Examiner* — Nicole M Ippolito

(57) ABSTRACT

The invention provides an object (10), that during use is at least partly submerged in water, wherein the object (100) is selected from the group consisting of a vessel (1) and an infrastructural object (15), the object (10) further comprising an anti-biofouling system (200) comprising an UV emitting element (210), wherein the UV emitting element (210) is configured to irradiate with UV radiation (221) during an irradiation stage one or more of (i) a first part (111) of an external surface (11) of said object (10) and (ii) water adjacent to said first part (111) of said external surface (11) of said object (10), wherein the object (10) further comprises protruding elements (100) with the UV emitting element (210) configured between the protruding elements (100) and configured depressed relative to the protruding elements (100).

10 Claims, 5 Drawing Sheets

(51) Int. Cl.

| | |
|---|---|
| ***B08B 17/00*** | (2006.01) |
| ***B08B 17/04*** | (2006.01) |
| ***E02B 17/00*** | (2006.01) |
| *B63B 59/04* | (2006.01) |

(58) Field of Classification Search
USPC ..... 250/493.1, 504 R
See application file for complete search history.

(56) References Cited

U.S. PATENT DOCUMENTS

| | | | | |
|---|---|---|---|---|
| 10,364,002 | B2 * | 7/2019 | Janssen | A61L 2/10 |
| 2006/0024508 | A1 | 2/2006 | D'Urso et al. | |
| 2006/0185116 | A1 | 8/2006 | Lee et al. | |
| 2013/0048877 | A1 | 2/2013 | Thoren et al. | |
| 2019/0241240 | A1 * | 8/2019 | Janssen | B63B 59/08 |

FOREIGN PATENT DOCUMENTS

| | | | |
|---|---|---|---|
| WO | 2012139172 | A1 | 10/2012 |
| WO | 2014188347 | A1 | 11/2014 |

* cited by examiner

METHOD AND DEVICE FOR BIOFOULING PREVENTION ON VESSELS BY MEANS OF UV RADIATION AND SURFACE MODIFICATION

CROSS-REFERENCE TO PRIOR APPLICATIONS

This application is the U.S. National Phase application under 35 U.S.C. § 371 of International Application No. PCT/EP2016/061641 filed on 24 May 2016, which claims the benefit of European Patent Application No. 15170650.4, filed on 4 Jun. 2015. These applications are hereby incorporated by reference herein.

FIELD OF THE INVENTION

The invention relates to an object that during use is at least partly submerged in water, especially a vessel or an infrastructural object.

BACKGROUND OF THE INVENTION

Anti-biofouling methods are known in the art. US2013/0048877, for instance, describes a system for anti-biofouling a protected surface, comprising an ultraviolet light source configured to generate ultraviolet light, and an optical medium disposed proximate to the protected surface and coupled to receive the ultraviolet light, wherein the optical medium has a thickness direction perpendicular to the protected surface, wherein two orthogonal directions of the optical medium orthogonal to the thickness direction are parallel to the protected surface, wherein the optical medium is configured to provide a propagation path of the ultraviolet light such that the ultraviolet light travels within the optical medium in at least one of the two orthogonal directions orthogonal to the thickness direction, and such that, at points along a surface of the optical medium, respective portions of the ultraviolet light escape the optical medium.

SUMMARY OF THE INVENTION

Biofouling or biological fouling (herein also indicated as "fouling") is the accumulation of microorganisms, plants, algae, and/or animals on surfaces. The variety among bio fouling organisms is highly diverse and extends far beyond attachment of barnacles and seaweeds. According to some estimates, over 1700 species comprising over 4000 organisms are responsible for biofouling. Biofouling is divided into microfouling which includes bio film formation and bacterial adhesion, and macrofouling which is the attachment of larger organisms. Due to the distinct chemistry and biology that determine what prevents organisms from settling, these organisms are also classified as hard or soft fouling types. Calcareous (hard) fouling organisms include barnacles, encrusting bryozoans, mollusks, polychaete and other tube worms, and zebra mussels. Examples of non-calcareous (soft) fouling organisms are seaweed, hydroids, algae and bio film "slime". Together, these organisms form a fouling community.

In several circumstances biofouling creates substantial problems. Machinery stops working, water inlets get clogged, and hulls of ships suffer from increased drag. Hence the topic of anti-fouling, i.e. the process of removing or preventing fouling from forming, is well known. In industrial processes, bio-dispersants can be used to control biofouling. In less controlled environments, organisms are killed or repelled with coatings using biocides, thermal treatments or pulses of energy. Non-toxic mechanical strategies that prevent organisms from attaching include choosing a material or coating with a slippery surface, or creation of nanoscale surface topologies similar to the skin of sharks and dolphins which only offer poor anchor points. Biofouling on the hull of ships causes a severe increase in drag, and thus increased fuel consumption. It is estimated that an increase of up to 40% in fuel consumption can be attributed to biofouling. As large oil tankers or container transport ships can consume up to €200.000 a day in fuel, substantial savings are possible with an effective method of anti-biofouling.

It surprisingly appears that one may effectively use UV radiation to substantially prevent bio fouling on surfaces that are in contact with sea water or water in lakes, rivers, canals, etc. Herewith, an approach is presented based on optical methods, in particular using ultra-violet light or radiation (UV). It appears that most micro-organisms are killed, rendered inactive or unable to reproduce with sufficient UV light. This effect is mainly governed by the total dose of UV light. A typical dose to kill 90% of a certain micro-organism is 10 $mW/h/m^2$.

Application of anti-fouling radiation may not be always straigthforward. One may use an optical medium to irradiate large areas but this solution may only be possible e.g. during a break in a harbor.

Surprisingly, a good solution appears to be the application of the optical media as a kind of second skin. A UV emitting element comprising such optical medium is associated with e.g. a hull of a ship and UV radiation emanates from a radiation escape surface of the UV emitting element. This radiation escape surface may then be configured as part of the external surface of the object. However, it appears that such optical media are not robust enough to cope with e.g. collisions with a quay or a pontoon, etc.

Hence, it is an aspect of the invention to provide an alternative system or method for prevention or reduction of bio fouling, which preferably further at least partly obviates one or more of above-described drawbacks.

In a first aspect, the invention provides an object that during use is at least partly submerged in water, wherein the object is selected from the group consisting of a vessel and an infrastructural object, the object further comprising an anti-bio fouling system (which may also be indicated as "anti-fouling lighting system") comprising an UV emitting element, wherein the UV emitting element is configured to irradiate with UV radiation (which may also be indicated as "anti-fouling light") during an irradiation stage one or more of (i) a first part of an external surface of said object and (ii) water adjacent to said first part of said external surface of said object, wherein the object further comprises protruding elements with the UV emitting element configured between the protruding elements and configured depressed relative to the protruding elements.

With such construction, the protruding element can be made of a robust material, such as e.g. steel, or a material that can absorb shocks, such as wood, while also the UV emitting element may not come into contact with a second object with which the object may collide, such as a quay, a pontoon, a(nother) vessel, etc. Other materials that may be used, alternatively or additionally, may be selected from the group consisting of rubber, silicones, etc. Hence, the protruding elements protrude relative to the lower lying UV emitting element (or anti-bio fouling system or optical medium). For instance, a smallest height difference between the protruding elements and the UV emitting element (or anti-biofouling system or optical medium) may be at least 1 mm, such as in the range of 1-500 mm, in general in the range of about 5-200 mm, such as 5-50 mm. The larger height differences may be relevant for more flexible materials, and the lower height differences may especially be used with non-flexible materials such as steel. The UV emitting element, especially the optical medium, may have a curved surface, such as a concave surface, with a lowest point substantially between two protruding elements. Hence, at the edges, i.e. close to the protruding element, the smallest height difference may be smaller than in between two protruding elements (see further also below). Alternatively or additionally, a back side of the optical medium, arranged closest to the (original) external surface may be curved. Such curvature may be used to better distribute the UV radiation over a radiation escape surface of the optical medium. Hence, in general, the most remote parts of the protruding elements, with remote defined relative to the object, are more remote from the object than the UV emitting element. Therefore, these elements are herein indicated as protruding elements. When colliding with e.g. a quay or (other) vessel, the protruding elements will protect the object. The protruding elements are thus especially configured to protect the UV emitting element and/or the anti-bio fouling system against a collision of the object with another object.

Herein, the phrase "object that during use is at least partly submerged in water" especially refers to objects such as vessels and infrastructural objects that have aquatic applications. Hence, during use such object will be in general in contact with the water, like a vessel in the sea, a lake, a canal, a river, or another waterway, etc. The term "vessel" may e.g. refer to e.g. a boat or a ship, etc., such as a sail boat, a tanker, a cruise ship, a yacht, a ferry, a submarine, etc. etc. The term "infrastructural object" may especially refer to aquatic applications that are in general arranged substantially stationary, such as a dam, a sluice, a pontoon, an oilrig, etc. The term "external surface" especially refers to the surface that may be in physical contact with water. In the case of pipes this may apply to one or more of the internal pipe surface and the external pipe surface. Hence, instead of the term "external surface" also the term "fouling surface" may be applied. Further, in such embodiments the term "water line" may also refer to e.g. filling level. Especially, the object is an object configured for marine applications, i.e. application in or near to a sea or an ocean. Such objects are during their use at least temporarily, or substantially always, at least partly in contact with the water. The object may be at least partly below the water (line) during use, or may substantially be all of its time below the water (line), such as for submarine applications.

Due to this contact with the water, biofouling may occur, with the above indicated disadvantages. Bio fouling will occur at the surface of an external surface ("surface) of such object. The surface of an (element of the) object to be protected may comprise steel, but may optionally also comprise another material, such as e.g. selected from the group consisting of wood, polyester, composite, aluminium, rubber, hypalon, PVC, glass fiber, etc. Hence, instead of a steel hull, the hull may also be a PVC hull or a polyester hull, etc. Instead of steel, also another iron material, such as an (other) iron alloys may be used.

Herein, the term "fouling" or "biofouling" or "biological fouling" are interchangebly used. Above, some examples of fouling are provided. Bio fouling may occur on any surface in water, or close to water and being temporarily exposed to water (or another electrically conductive aqueous liquid). On such surface bio fouling may occur when the element is in, or near water, such as (just) above the water line (like e.g. due to splashing water, such as for instance due to a bow wave). Between the tropics, biofouling may occur within hours. Even at moderate temperatures, the first (stages of) fouling will occur within hours; as a first (molecular) level of sugars and bacteria.

The anti-bio fouling system comprises at least an UV emitting element. Further, the anti-biofouling system may comprise a control system (see also below), an electrical energy supply, such as a local energy harvesting system (see also below), etc.

The term "anti-bio fouling system" may also refer to a plurality of such systems, optionally functionally coupled to each other, such as e.g. controlled via a single control system. Further, the anti-biofouling system may comprise a plurality of such UV emitting elements. Herein, the term "UV emitting element" may (thus) refer to a plurality of UV emitting elements. For instance, in an embodiment a plurality of UV emitting elements may be associated to an external surface of the object, such as a hull, or may be comprised by such surface (see also below), whereas e.g. a control system may be configured somewhere within the object, such as in a control room or wheel house of a vessel.

The surface or area on which fouling may be generated is herein also indicated as fouling surface. It may e.g. be the hull of a ship and/or an emission surface of an optical medium (see also below). To this end, the UV emitting element provides UV radiation (anti-fouling light) that is applied to prevent formation of biofouling and/or to remove biofouling. This UV radiation (anti-fouling light) especially at least comprises UV radiation (also indicated as "UV light"). Hence, the UV emitting element is especially configured to provide UV radiation. Thereto, the UV emitting element comprises a light source. The term "light source" may also relate to a plurality of light sources, such as 2-20 (solid state) LED light sources, though many more light sources may also be applied. Hence, the term LED may also refer to a plurality of LEDs. Especially, the UV emitting element may comprise a plurality of light sources. Hence, as indicated above, the UV emitting element comprises one or more (solid state) state light sources. The LEDs may be (OLEDs or) solid state LEDs (or a combination of these LEDs). Especially, the light source comprises solid state LEDs. Hence, especially, the light source comprises a UV LED configured to provide one or more of UVA and UVC light (see also below). UVA may be used to impair cell walls, whereas UVC may be used to impair DNA. Hence, the light source is especially configured to provide the UV radiation. Herein, the term "light source" especially refers to a solid state light source.

Ultraviolet (UV) is that part of electromagnetic light bounded by the lower wavelength extreme of the visible spectrum and the X-ray radiation band. The spectral range of UV light is, by definition between about 100 and 400 nm (1 nm=$10^{-9}$ m) and is invisible to human eyes. Using the CIE classification the UV spectrum is subdivided into three bands: UVA (long-wave) from 315 to 400 nm; UVB (medium-wave) from 280 to 315 nm; and UVC (short-wave) from 100 to 280 nm. In reality many photobiologists often speak of skin effects resulting from UV exposure as the weighted effect of wavelength above and below 320 nm, hence offering an alternative definition.

A strong germicidal effect is provided by the light in the short-wave UVC band. In addition erythema (reddening of the skin) and conjunctivitis (inflammation of the mucous membranes of the eye) can also be caused by this form of light. Because of this, when germicidal UV-light lamps are used, it is important to design systems to exclude UVC leakage and so avoid these effects. In case of immersed light sources, absorption of UV light by water may be strong enough that UVC leaking is no problem for humans above the liquid surface. Hence, in an embodiment the UV radiation (anti-fouling light) comprises UVC light. In yet another embodiment, the UV radiation comprises radiation selected from a wavelength range of 100-300 nm, especially 200-300 nm, such as 230-300 nm. Hence, the UV radation may especially be selected from UVC and other UV radiation up to a wavelength of about 300 nm. Good results are obtained with wavelengths within the range of 100-300 nm, such as 200-300 nm.

As indicated above, the UV emitting element is configured to irradiate with said UV radiation (during an irradiation stage) one or more of (i) said part of said external surface and (ii) water adjacent to said part of said external surface. The term "part" refers to part of the external surface of an object, such as e.g. a hull or a sluice (door). However the term "part" may also refer to substantially the entire external surface, such as the external surface of the hull or sluice. Especially, the external surface may comprise a plurality of parts, which may be irradiated with the UV light of one or more light sources, or which may be irradiated with the UV radiation of one or more UV emitting element. Each UV emitting element may irradiate one or more parts. Further, there may optionally be parts that receive UV radiation of two or more UV emitting elements.

In general, there may be distinguished between two main embodiments. One of the embodiments includes the part of the external surface being irradiated with the UV radiation with between the light source and UV emitting element water (or air when above the water line), such as sea water, at least during the irradiation stage. In such embodiment, the part is especially comprised by the "original" external surface of the object. However, in yet another embodiment, the "original" external surface may be extended with a module, especially a relatively flat module, that is attached to the "original" external surface of the object (such as the hull of a vessel), whereby the module itself forms in fact the external surface. For instance, such module may be associated to the hull of a vessel, whereby the module forms (at least part of) the external surface. In both embodiments the UV emitting element especially comprises a radiating exit surface (see further also below). However, especially in the latter embodiment wherein the UV emitting element may provide part of said external surface, such radiation escape surface may provide the part (as the first part and the radiation escape surface may essentially coincide; especially may be the same surface).

Hence, in an embodiment the UV emitting element is attached to said external surface. In yet a further specific embodiment the radiation escape surface of the anti-biofouling system is configured as part of said external surface. Hence, in some of the embodiments the object may comprise a vessel comprising a hull, and the UV emitting element is attached to said hull. The term "radiation escape surface" may also refer to a plurality of radiation escape surfaces (see also below).

In both general embodiments, the UV emitting element is configured to irradiate with said UV radiation (during an irradiation stage) water adjacent to said part of said external surface. In the embodiments wherein the module itself forms in fact the external surface, the UV emitting element is at least configured to irradiate with said UV radiation (during an irradiation stage) said part of said external surface, as it is in fact part of said external surface, and optionally also water adjacent to said part of said external surface. Hereby, biofouling may be prevented and/or reduced.

In an embodiment, a significant amount of a protected surface to be kept clean from fouling, preferably the entire protected surface, e.g. the hull of a ship, may be covered with a layer that emits germicidal light ("anti-fouling light"), in particular UV light.

In yet another embodiment, the UV radiation (anti-fouling light) may be provided to the surface to be protected via a waveguide, such as a fiber.

Hence, in an embodiment the anti-fouling lighting system may comprise an optical medium, wherein the optical medium comprises a waveguide, such as an optical fiber, configured to provide said UV radiation (anti-fouling light) to the fouling surface. The surface of e.g. the waveguide from which the UV radiation (anti-fouling light) escapes is herein also indicated as emission surface. In general, this part of the waveguide may at least temporarily be submerged. Due to the UV radiation (anti-fouling light) escaping from the emission surface, an element of the object that is during use at least temporarily exposed to the liquid (such as seawater), may be irradiated, and thereby anti-fouled. However, the emission surface per se may also be anti-fouled. This effect is used in some of the embodiments of the UV emitting element comprising an optical medium described below.

Embodiments with optical media are also described in WO2014188347. The embodiments in WO2014188347 are herein also incorporated by reference as they are combinable with the protruding elements, and other embodiments, described herein.

As indicated above, the UV emitting element may especially comprise a UV radiation escape surface. Hence, in a specific embodiment the UV emitting element comprises a UV radiation escape surface, with the UV emitting element especially being configured to provide said UV radiation downstream from said UV radiation escape surface of said UV emitting element. Such UV radiation escape surface may be an optical window through which the radiation escapes from the UV emitting element. Alternatively or additionally, the UV radiation escape surface may be the surface of a waveguide. Hence, UV radiation may be coupled in the UV emitting element into the waveguide, and escape from the element via a (part of a) face of the waveguide. As also indicated above, in embodiments the radiation escape surface may optionally be configured as part of the external surface of the object.

The terms "upstream" and "downstream" relate to an arrangement of items or features relative to the propagation of the light from a light generating means (here the especially the first light source), wherein relative to a first position within a beam of light from the light generating means, a second position in the beam of light closer to the light generating means is "upstream", and a third position within the beam of light further away from the light generating means is "downstream".

As indicated above, the object or the anti-biofouling system may comprise a plurality of radiation escape surfaces. In embodiments this may refer to a plurality of anti-biofouling systems. However, alternatively or additionally, in embodiments this may refer to an anti-biofouling system comprising a plurality of UV radiation emitting elements. Such anti-biofouling system may thus especially include a plurality of light sources for providing UV radiation. However, alternatively or additionally, in embodiments this may (also) refer to an UV emitting element comprising a plurality of light sources configured to provide the UV radiation. Note that an UV emitting element with a single UV radiation escape surface may (still) include a plurality of light sources.

The anti-biofouling system is especially configured to provide UV radiation to the part of the object or to water adjacent to this part. This especially implies that during an irradiation stage the UV radiation is applied. Hence, there may optionally also be periods wherein no UV radiation is applied at al. This may (thus) not only be due to e.g. a control system switching of one or more of the UV emitting elements, but may e.g. also be due to predefined settings such as day and night or water temperature, etc. For instance, in an embodiment the UV radiation is applied in a pulsed way.

Especially, the object or the anti-bio fouling system comprises a control system, especially the object comprises such comprises such control system, which may optionally be integrated in the anti-bio fouling system or elsewhere in the object.

Hence, in a specific embodiment or aspect, the anti-biofouling system is configured for preventing or reducing biofouling on a fouling surface of an object, that during use is at least temporarily exposed to water, by providing an anti-fouling light (i.e. UV radiation) to said fouling surface or water adjacent thereto, the anti-fouling lighting system comprising (i) a lighting module comprising (i) a light source configured to generate said anti-fouling light; and (ii) a control system configured to control an intensity of the anti-fouling light as function of one or more of (i) a feedback signal related to a bio fouling risk and (ii) a timer for time-based varying the intensity of the anti-fouling light.

In a specific embodiment, the control system is especially configured to control said UV radiation as function of input information comprising information of one or more of (i) a location of the object, (ii) movement of the object, (iii) a distance (d) of the object to a second object, and (iv) a position of the part of the external surface relative to the water. Hence, especially the anti-bio fouling system is configured to control said UV radiation as function of input information comprising information of a human UV radiation exposure risk.

Especially, the anti-bio fouling system may be configured to provide said anti-fouling light via an optical medium to said fouling surface, wherein the lighting module further comprises (ii) said optical medium configured to receive at least part of the UV radiation (anti-fouling light), the optical medium comprising an emission surface configured to provide at least part of said UV radiation (anti-fouling light). Further, especially the optical medium comprises one or more of a waveguide and an optical fiber, and wherein the UV radiation (anti-fouling light) comprises one or more of UVA and UVC light. These waveguides and optical medial are herein further not discussed in detail.

In a further aspect, the invention also provides a method of anti-(bio)fouling (a part of) an external surface of an object that is during use at least temporarily exposed to water, the method comprising: providing the anti-bio fouling system as defined herein to the object, generating the UV radiation (during use of the object), optionally as function of one or more of (i) a feedback signal (such as related to bio fouling risk and/or a human UV radiation exposure risk), and (ii) a timer for (periodically) varying the intensity of the UV radiation (anti-fouling light), and providing said UV radiation (during an irradiation stage) to (the part of) the external surface.

As indicated above, the UV emitting element may especially comprise an optical medium, such as waveguide plate. Such optical medium may advantageously be configured between the protruding elements. Hence, in a specific embodiment the UV emitting element comprises an optical medium configured to provide said UV radiation of a light source to said one or more of (i) said first part of said external surface of said object and (ii) water adjacent to said first part of said external surface of said object, and wherein the optical medium is configured between the protruding elements and configured depressed relative to the protruding elements. Especially, a smallest height difference between the protruding elements and the optical medium may be at least 1 mm, such as in the range of 1-500 mm, in general in the range of about 5-200 mm, like 5-50 mm.

The optical medium may also be provided as a (silicone) foil for applying to the protected surface, the foil comprising at least one light source for generating anti-fouling light and a sheet-like optical medium for distributing the UV radiation across the foil. In embodiments the foil has a thickness in an order of magnitude of a couple of millimeters to a few centimeters, such as 0.1-5 cm, like 0.2-2 cm. In embodiments, the foil is not substantially limited in any direction perpendicular to the thickness direction so as to provide substantially large foil having sizes in the order of magnitude of tens or hundreds of square meters. The foil may be substantially size-limited in two orthogonal directions perpendicular to the thickness direction of the foil, so as to provide an anti-fouling tile; in another embodiment the foil is substantially size-limited in only one direction perpendicular to a thickness direction of the foil, so as to provide an elongated strip of anti-fouling foil. Hence, the optical medium, and even also the lighting module, may be provided as tile or as strip. The tile or strip may comprise a (silicone) foil.

Further, in an embodiment the optical medium may be disposed proximate (including optionally attached to) to the protected surface and coupled to receive the ultraviolet light, wherein the optical medium has a thickness direction perpendicular to the protected surface, wherein two orthogonal directions of the optical medium orthogonal to the thickness direction are parallel to the protected surface, wherein the optical medium is configured to provide a propagation path of the ultraviolet light such that the ultraviolet light travels within the optical medium in at least one of the two orthogonal directions orthogonal to the thickness direction, and such that, at points along a surface of the optical medium, respective portions of the ultraviolet light escape the optical medium.

In an embodiment the lighting module comprises a two-dimensional grid of light sources for generating UV radiation and the optical medium is arranged to distribute at least part of the UV radiation from the two-dimensional grid of light sources across the optical medium so as to provide a two-dimensional distribution of UV radiation exiting the light emitting surface of the light module. The two-dimensional grid of light sources may be arranged in a chicken-wire structure, a close-packed structure, a rows/columns structure, or any other suitable regular or irregular structure. The physical distance between neigboring light sources in the grid may be fixed across the grid or may vary, for example as a function of light output power required to provide the anti-fouling effect or as function of the location of the lighting module on the protected surface (e.g location on the hull of a ship). Advantages of providing a two-dimensional grid of light sources include that the UV radiation may be generated close to the areas to be protected with UV radiation illumination, and that it reduces losses in the optical medium or light guide and that it is increasing homogeneity of the light distribution. Preferably, the UV radiation is generally homogeneously distributed across the emission surface; this reduces or even prevents under-illuminated areas, where fouling may otherwise take place, while at the same time reducing or preventing energy waste by over-illumination of other areas with more light than needed for anti-fouling. In an embodiment, the grid is comprised in the optical medium. In yet an embodiment, the grid may be comprised by a (silicone) foil. The invention is however not limited to silicone material as UV transmissive material (optical medium material). Also other (polymeric) materials may be applied that are transmissive for UV radiation, such as silica, PDMS (polydimethylsiloxane), teflon, and optionally (quartz) glass, etc.

The UV emitting element, or optical medium, may be configured between protruding elements. This also includes embodiments wherein the UV emitting element or optical medium may include through holes through which the protruding elements protrude.

Hence, as indicated above, the optical medium may be configured to receive UV radiation of an external light source, which couples its radiation into the waveguide, or the light sources may be embedded in the optical medium (and is by definition configured to couple its UV radiation into the optical medium). Of course, combinations may also be applied. Hence, in an embodiment the optical medium comprises one or more of said light sources, wherein said one or more light sources comprise solid state light sources, and wherein said optical medium comprises silicone as waveguide material.

The protruding elements and the UV emitting element can be arranged in different ways to the object. This may e.g. depend on whether the object has been produced or has been adapted to include e.g. a surface profile with extending elements, i.e. the protruding elements. Hence, in an embodiment the external surface comprises said protruding elements. Therefore, the object may already include a surface profile, or a surface profile may later be applied to the object. However, also the anti-bio fouling system may include the protruding elements. Hence, in embodiments one or more of (i) the object comprises a surface profile comprising said protruding elements, wherein said surface profile is attached to said external surface, and (ii) the anti-bio fouling system comprises said protruding elements. Especially, a single unit may be provided to the object, including the surface profile and/or protruding elements as well as the anti-bio fouling system. Hence, in a further embodiment the object comprises a UV emitting unit comprising said surface profile comprising said protruding elements, and an optical medium as defined herein, wherein said surface profile is attached to said external surface. Such UV emitting unit may especially be useful for existing objects that do not have a (suitable) surface profile. The term "UV emitting unit" is used for a single unit that can be applied to the external surface, but may also be used to an assembly of elements provided to the external surface that comprises the same elements ad defined for the UV emitting unit.

The surface profile provides a cavity, or a plurality of cavities configured to receive the anti-biofouling system(s), the UV emitting element(s) or the optical medium/media. Also combinations of such embodiments may be applied. The surface profile especially comprises the protruding elements and optionally also a (curved) back side. Light sources and/or optical fibers may be configured to such back side.

As already indicated above, when applying the UV emitting element to the external surface, in fact part of the UV emitting element may in embodiments become the external surface, as the original external surface is at least partly covered with the UV emitting element, especially the optical medium. This may substantially prevent bio fouling on the original external surface but replaces the problem to the UV emitting element (or the optical medium). Advantageously, the radiation escape surface of the optical medium may be used as external surface, with the UV radiation removing bio-fouling and/or preventing bio-fouling. Hence, in an embodiment the optical medium is configured to provide UV radiation of a light source to a radiation escape surface of the optical medium, wherein the optical medium is configured between the protruding elements and configured depressed relative to the protruding elements, and wherein the radiation escape surface of the anti-bio fouling system is configured as part of said external surface. The radiation escape surface and/or water adjacent to the radiation escape surface (during use of the object) may thereby be irradiated with the UV radiation.

As indicated above, a suitable material for the protruding elements is e.g. steel, because of its hardness and also because of the fact that many hulls are made of steel. However, the protruding elements may also be of another material, such as wood or rubber, etc. (see also above). This may allow a relatively easy replacement after damage of the protruding elements. The protruding elements may be elongated, such as strips or rims, or may include pin-type protruding elements. Of course, different type of protruding elements may be comprised by the object. Smaller protruding elements may have cross-sections having a circular, square, rectangular, oval, or hexagonal shape, though other shapes may be possible. Cross-sectional areas (parallel to the external surface) of the protruding elements may e.g. be in the range of 1 $cm^2$-250 $m^2$. However, the protruding elements may also be elongate, such as e.g. (a rim) over the length of the hull of a vessel. Hence, in specific embodiment the protruding elements comprise steel, and the protruding elements are configured as protruding rims with the UV emitting element configured between the protruding rims.

In a further embodiment, the optical medium, the UV emitting element, or the anti-bio fouling lighting system may be configured in an indentation or recession of a unit comprising such indentation or recession, with the UV emitting element, or the anti-bio fouling lighting system, respectively, being configured depressed relative to the unit. For instance, a flat steel surface, in which (circular) indentations are made, each 'filled' with a the UV emitting element, or the anti-biofouling lighting system, respectively. This may leaves the protruding elements as one big, connected 'shape': a plane with e.g. circular 'dimples' like a golfball.

Light sources may be arranged between the protruding elements, such as at an edge of an optical medium or embedded in the optical medium. The optical medium may e.g. comprise a (silicone) waveguide. In yet another embodiment the optical medium may comprise a waveguide with embedded therein an optical fiber for providing the UV radiation over the length of the optical medium. The light sources (or fiber(s)) may be arranged substantially in the middle between protruding elements. This may provide a good distribution of the UV radiation over the optical medium. However, the light sources (or fiber(s)) may also be arranged closer to one nearest neighbor protruding element than to another nearest neighbor protruding element. For instance, (set of) two light sources (or two fibers) may be arranged, each closer to a respective protruding element. This may also guarantee a good distribution of the light, but may also provide additional protection to the light sources (or fibers). Therefore, in an embodiment the UV emitting element comprises a light source, wherein the light source has two or more nearest neighboring protruding elements, wherein a first shortest distance (d1) between a first nearest neighboring protruding element and the light source is equal to or less than 50% of a second shortest distance (d2) between a second nearest neighboring protruding element and said light source. This definition may also apply when instead of e.g. an embedded light source an optical fiber is applied. Further, additionally or alternatively a smallest height difference (d3) between the protruding elements and the UV emitting element is especially at least 1 mm.

In a specific embodiment, the object comprises a vessel and the external surface comprises a steel hull. However, other (hull) materials may also be possible, such as e.g. selected from the group consisting of wood, polyester, composite, aluminim, rubber, hypalon, PVC, glass fiber, etc.

In yet a further aspect, the invention also provides the anti-bio fouling system per se, i.e. an anti-biofouling system comprising an UV emitting element for application of UV radiation (to a part of an external surface of the object), wherein the UV emitting element comprises one or more light sources and is configured to irradiate with said UV radiation (during an irradiation stage) one or more of (i) said part of said external surface and (ii) water adjacent to said part of said external surface, see further also below. The invention is further especially explained with reference to the bio-antifouling system in combination with the object. Hence, in yet a further aspect the invention provides a UV emitting unit comprising a surface profile comprising a protruding element, and an optical medium configured to provide UV radiation of a light source to a radiation escape surface of the optical medium, wherein the optical medium is configured depressed relative to the protruding elements. In a specific embodiment, the UV emitting unit comprises a surface profile comprising (at least two) protruding elements, and an optical medium configured to provide UV radiation of a light source to a radiation escape surface of optical medium, wherein the optical medium is configured between the protruding elements and configured depressed relative to the protruding elements.

In yet a further specific embodiment, the UV emitting unit comprises protruding elements, wherein the optical medium is configured between the protruding elements, wherein the optical medium comprises one or more of said light sources, wherein said one or more light sources comprise solid state light sources, and wherein said optical medium especially comprises silicone as waveguide material, wherein the surface profile and protruding elements especially comprise steel, and wherein a smallest height difference between the protruding elements and the UV emitting element is at least 1 mm (or larger, see also above). Especially, a smallest height difference between the protruding elements and the optical medium is at least 1 mm (or larger, see also above).

Hence, in an embodiment (at least part of) the external surface of the object may include the protruding elements and the radiation escape surface(s)

In yet a further aspect, the invention also provides a method of providing an anti-bio fouling system to an object, that during use is at least temporarily exposed to water, the method comprising providing, such as integrating in the object and/or attaching to an external surface, the anti-bio fouling system to the object, such as a vessel, with the UV emitting element configured to provide said UV radiation to one or more of a part of an external surface of the object and water (being) adjacent to said part (during use). Especially, the UV emitting element is attached to the external surface, or may even be configured as (first) part of the external surface. As indicated above, the anti-bio fouling system may be applied in different ways to the object. Hence, in a further aspect the invention also provides a method of protecting an object that during use is at least partly submerged in water against biofouling, wherein the object is selected from the group consisting of a vessel and an infrastructural object, the method comprising providing (i) an anti-biofouling system comprising an UV emitting element, wherein the UV emitting element is configured to irradiate with UV radiation during an irradiation stage one or more of (i) a first part of an external surface of said object and (ii) water adjacent to said first part of said external surface of said object, and (ii) protruding elements to said object, wherein the UV emitting element is configured between the protruding elements and configured depressed relative to the protruding elements.

In a specific embodiment of the method, the external surface comprises said protruding elements, and the method (further) comprises providing the anti-bio fouling system to said object, wherein the UV emitting element is configured between the protruding elements and configured depressed relative to the protruding elements. For instance, this may be the case when the hull of a vessel comprises a profile, either generated during production or applied afterwards to the hull. However, in yet another embodiment, the method comprises providing an UV emitting unit comprising (i) a surface profile comprising said protruding elements, and (ii) an optical medium according to claim 2, wherein the optical medium is configured between the protruding elements and configured depressed relative to the protruding elements, wherein the method further comprises attaching said surface profile to said external surface. In such embodiment, a complete unit is associated with the external surface of the object.

The terms "visible", "visible light" or "visible emission" refer to light having a wavelength in the range of about 380-780 nm.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale.

DETAILED DESCRIPTION OF THE EMBODIMENTS

Figure 1A:
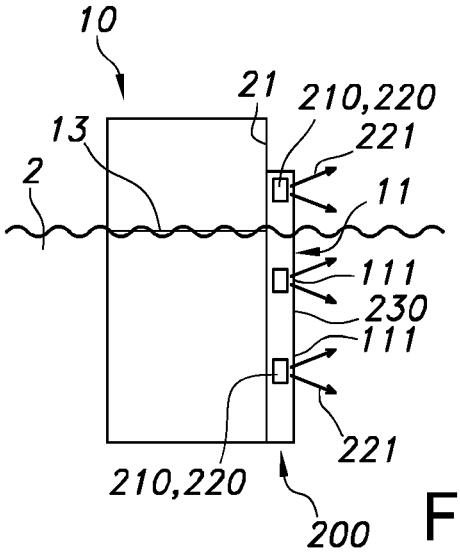
FIGS. 1*a*-1*b* schematically depict some embodiments and variants.

FIG. 1*a* schematically depicts an object 10 that during use is at least partly submerged in water 2. The object 100 is selected from the group consisting of a vessel 1 and an infrastructural object 15 (see also FIG. 1*b*). The object 10 further comprises an anti-bio fouling system 200 comprising an UV emitting element 210, wherein the UV emitting element 210 is configured to irradiate with UV radiation 221 during an irradiation stage one or more of (i) a first part 111 of an external surface 11 of said object 10 and (ii) water 2 adjacent to said first part 111 of said external surface 11 of said object 10. Reference 13 indicates the water line; reference LL indicates a load line (of a vessel 1). The protruding elements may especially only be arranged e.g. within a range of e.g. 1 meter above and 1 meter below the load line LL (see also below).

Figure 1B:
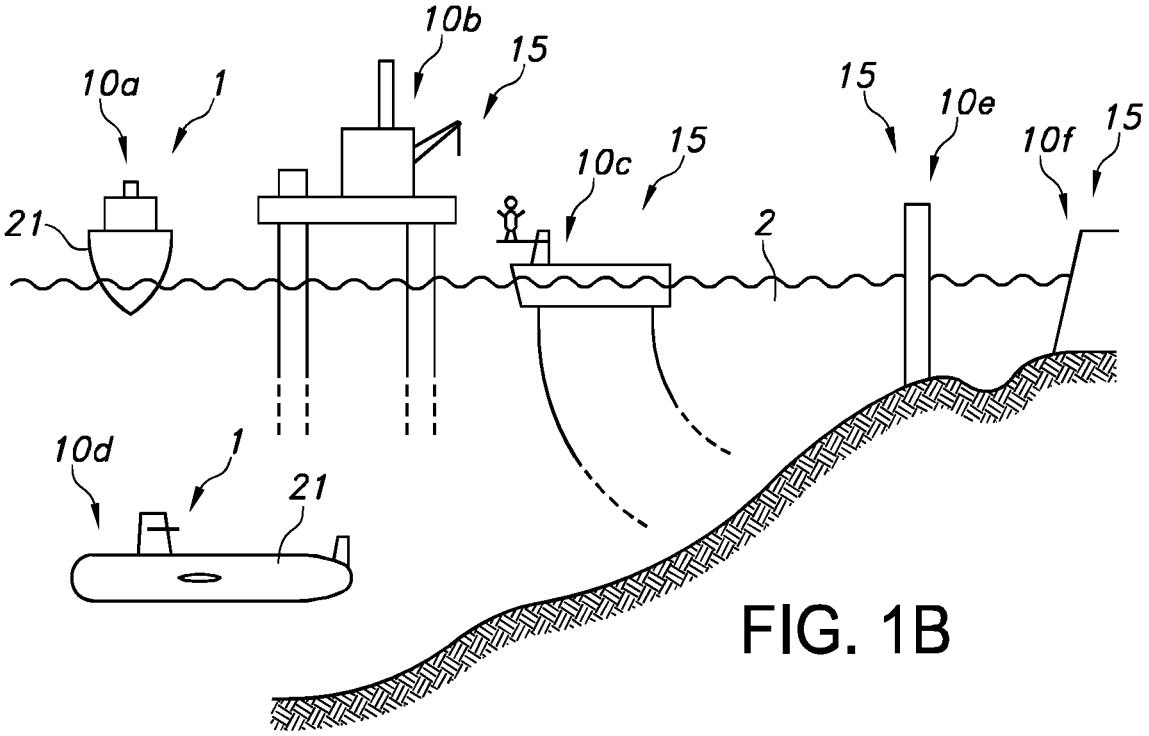

As indicated above, the term "vessel", indicated with reference 1, may e.g. refer to e.g. a boat or a ship (ref 10*a* in FIG. 1*b*), etc., such as a sail boat, a tanker, a cruise ship, a yacht, a ferry, a submarine (ref. 10*d* in FIG. 1*b*), etc., like schematically indicated in FIG. 1*b*. The term "infrastructural object", indicated with reference 15, may especially refer to aquatic applications that are in general arranged substantially stationary, such as a dam/sluice (references 10*e*/10*f* in FIG. 1*b*), a pontoon (ref. 10*c* in FIG. 1*b*), an oilrig (ref. 10*b* in FIG. 1*b*), etc.

In a specific embodiment, the object 10 further comprises a control system 300 (see e.g. FIG. 2*g*) configured to control said UV radiation 221 as function of input information comprising information of one or more of (i) a location of the object 10, (ii) movement of the object 10, (iii) a distance of the object 10 to a second object 20, and (iv) a position of the part 111 of the external surface 11 relative to the water. Hence, especially the anti-bio fouling system is configured to control said UV radiation as function of input information comprising information of a human UV radiation exposure risk. In an embodiment, the anti-bio fouling system 200 may include an integrated control system 300 and an integrated sensor 310. Hence, the control system 300 may be configured to control an intensity of the anti-fouling light as function of one or more of (i) a feedback signal related to a bio fouling risk and (ii) a timer for time-based varying the intensity of the anti-fouling light. Such feedback signal may be provided by the sensor.

Figure 2A:
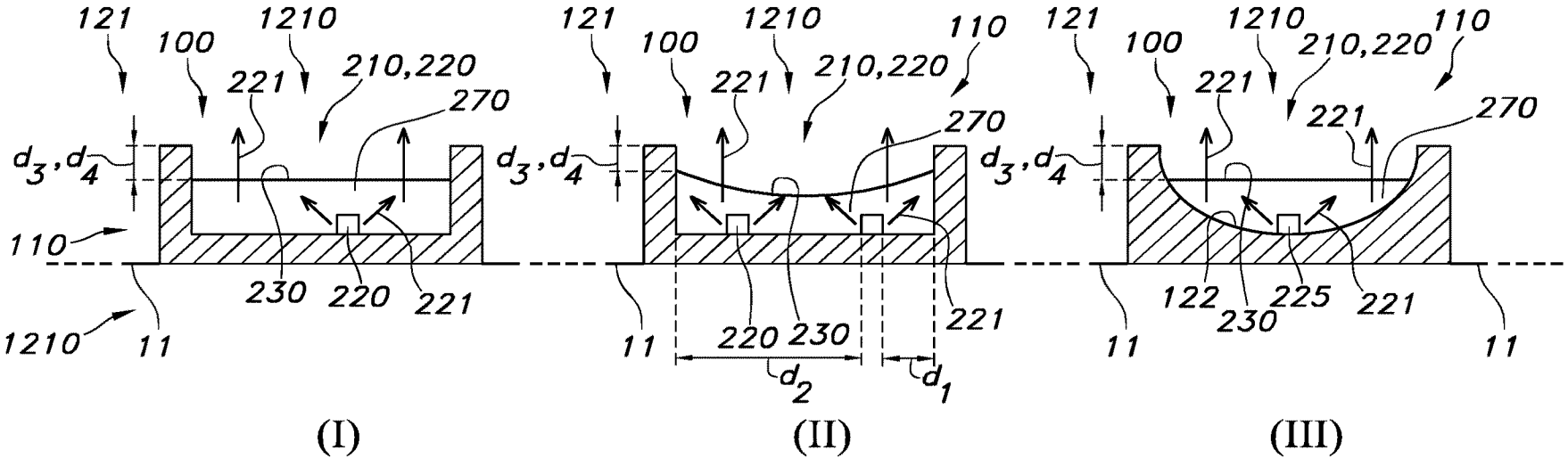
FIGS. 2*a*-2*j* schematically depict some embodiments and variants.
Figure 2B:
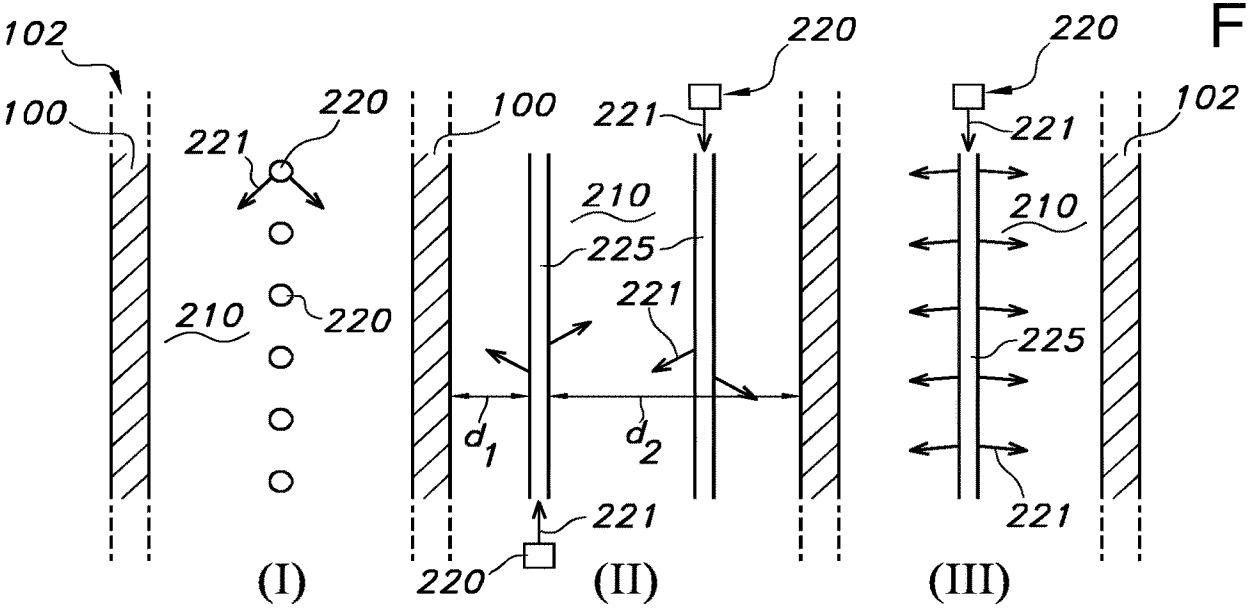
Figure 2C:
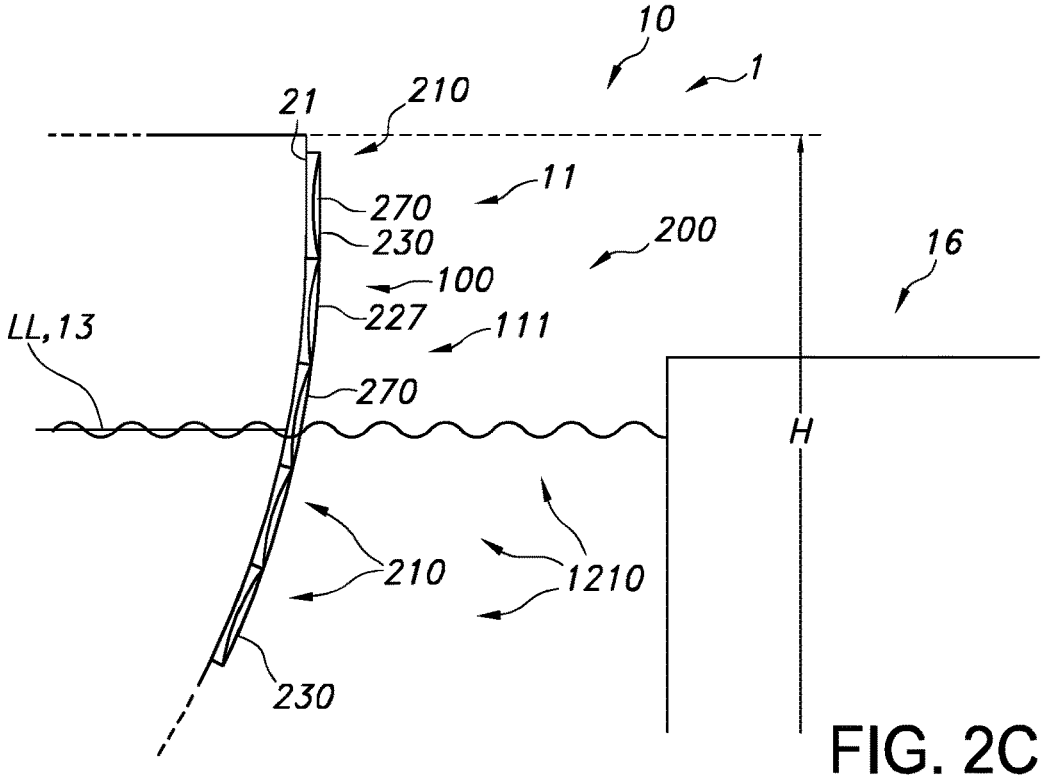

The object 10 may further comprises protruding elements 100 with the UV emitting element 210 configured between the protruding elements 100 and configured depressed relative to the protruding elements 100. FIGS. 2*a*-2*c* schematically depict how the anti-biofouling system 200 or the UV emitting element 210 may be configured between protruding elements. Here, by way of example the anti-bio fouling system 200 essentially consists of the UV emitting element 210, which essentially consists of an optical medium 270 (waveguide) for guiding UV radiation to the radiation escape surface, indicated with reference 230, of the optical medium 270. However, the anti-bio fouling system 200 may also comprise a plurality of UV emitting elements 210, and also other elements, such as a control unit, etc. (see also e.g. above). In FIG. 2*a* schematically three variants of the configuration of the anti-biofouling system 200/UV emitting elements 210/optical media 270 are shown.

In the variant I, the radiation escape window is 230 is substantially flat and the protruding elements 100 are especially rims (see also below), defining a substantially rectangular cavity 121 wherein the bio fouling system 200/UV emitting elements 210/optical media 270 is configured, depressed relative to the protruding elements 100. Reference d3 indicates the height difference between protruding element 100 and the UV emitting element; 210; reference d4 indicates the height difference between protruding element 100 and the optical medium 270. By way of example, a light source 220, such as a solid state light source, is embedded in the optical medium.

In variant II, substantially the same cavity 121 is provided between the protruding elements 100, but the radiation escape surface 230 is concave. Here, by way of example two light sources 220 are embedded in the optical medium 270. Note that the distances (of each respective light source) to the protruding elements 100 differ. Hence, the light source 220 has two or more nearest neighboring protruding elements 100, wherein a first shortest distance d1 between a first nearest neighboring protruding element 100 and the light source 220 is equal to or less than 50% of a second shortest distance d2 between a second nearest neighboring protruding element 100 and said light source 220.

In variant III, the cavity 121 provided between the protruding elements 100 has a concave bottom or cavity back side 122. Here, the radiation escape surface 230 is chosen to be flat. Further, by way of example an optical fiber or fiber 225 is comprised by the optical medium 270. A light source 220 (not depicted) may couple UV radiation 221 into the fiber, which on its turn couples light into the optical medium. Methods to couple UV radiation into a fiber and/or into an optical medium are known in the art. FIG. 2*a* may also depict embodiments of UV emitting units 1210 comprising a surface profile 110 comprising protruding elements 100, and an optical medium 270 configured to provide UV radiation 221 of a light source 220 to a radiation escape surface 230 of optical medium 270, wherein the optical medium 270 is configured between the protruding elements 100 and configured depressed relative to the protruding elements 100. Such unit 1210 may be configured to an existing external surface of an object (see also FIG. 2*c*).

FIG. 2*b* schematically depicts three variants of configurations of the UV emitting elements and the protruding elements 100, here configured as rims 102, in a top view. Variant I of FIG. 2*b* may e.g. correspond to variant I of FIG. 2*a*. Note the row of light sources 220. Variant II in FIG. 2*b* may correspond to variant II of FIG. 2*a*, though here two fibers 225 have been chosen (instead of light sources 220). Note that at an edge the light source 220 is configured to couple UV radiation 221 into the fiber 225. Variant III of FIG. 2*b* may e.g. correspond to variant III of FIG. 2*a*, with a fiber 225 between the two rims 102.

FIG. 2*c* schematically depicts a configuration of a plurality of UV emitting elements 210 to an external surface 11 of an object 10, such as a vessel 1. The UV emitting elements 210 may e.g. be comprised by a single anti-biofouling system 200. Due to the protruding elements 100, a collision with e.g. a quay 16 is not necessarily detrimental to the in general more sensible optical elements, such as a light source or a UV emitting element 210. Reference 13 indicates the water line (also indicated with LL).

Figure 2D:
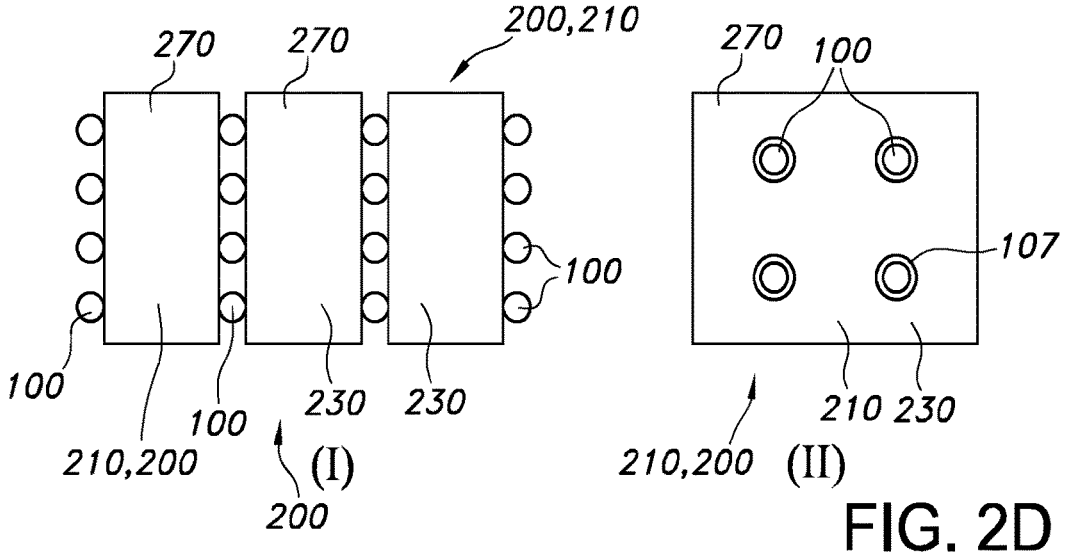
Figure 2E:
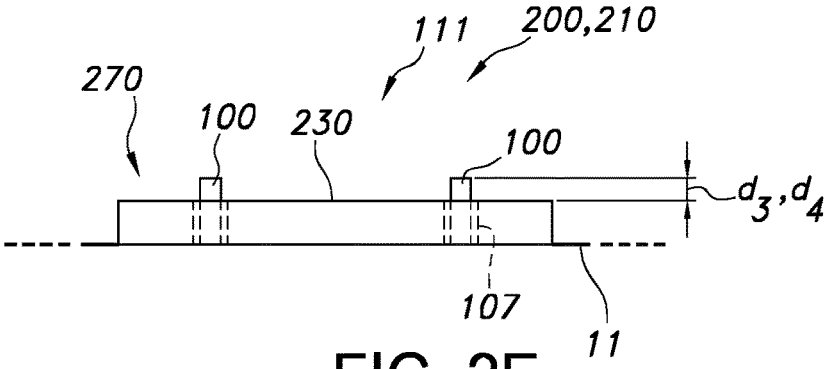

Instead of rims, also pin shaped or otherwise shaped protruding elements 100 may be applied. FIGS. 2*d*-2*e* schematically depict some embodiment, with FIG. 2*d*, variant I showing the UV emitting elements being configured between the protruding elements 100, and with variant II showing a top view wherein the protruding elements 100 protrude through openings 107 in the UV emitting element 210, such as an opening in the optical medium 270. FIG. 2*e* schematically depicts a similar variant as variant II of FIG. 2*d*, but now in side view or cross-sectional view (perpendicular cross-section).

Figure 2F:
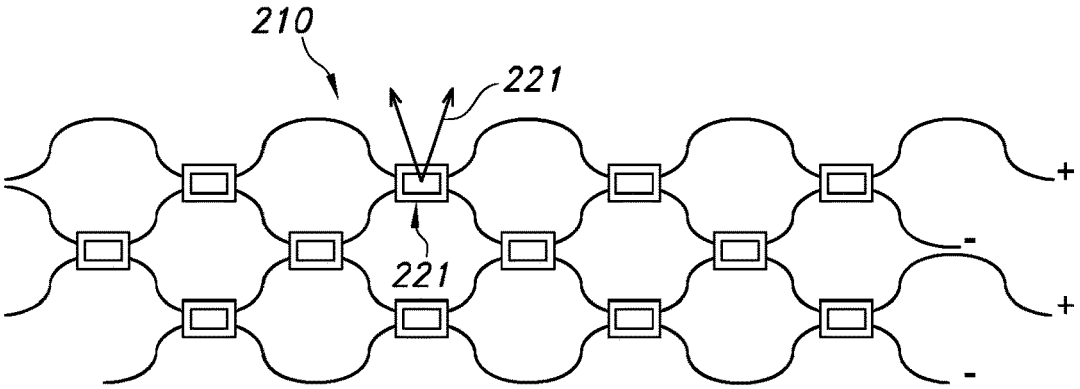

FIG. 2*f* shows a chicken-wire embodiment where light sources 210, such as UV LEDs, are arranged in a grid and connected in a series of parallel connections. The LEDs can be mounted at the nodes either through soldering, gluing or any other known electrical connection technique for connecting the LEDs to the chicken wires. One or more LEDs can be placed at each node. DC or AC driving can be implemented. If AC is used, then a couple of LEDs in anti parallel configuration may be used. The person skilled in the art knows that at each node more than one couple of LEDs in anti parallel configuration can be used. The actual size of the chicken-wire grid and the distance between UV LEDs in the grid can be adjusted by stretching the harmonica structure. The chicken-wire grid may be embed in an optical medium.

Figure 2G:
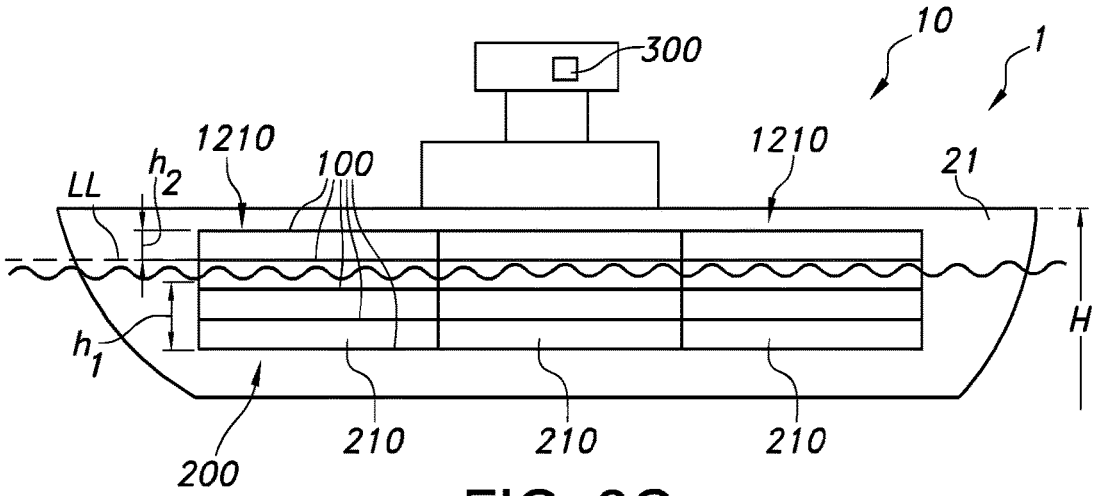

FIG. 2*g* schematically depicts an embodiment wherein a vessel 1, as embodiment of the object 10, comprises a plurality of anti-bio fouling systems 200 and/or a one or more of such anti-biofouling systems 200 comprising a plurality of UV emitting elements 210. For instance, dependent upon the height of the specific such anti-biofouling system 200 and/or the height of the UV emitting elements 210, such as relative to a water (line), the respective UV emitting elements 210 may be switched on. FIG. 2*g* also indicates the load line LL. About 0.5-2 m above, indicated with h2, and about 0.5-2 m below the load line LL, indicated with h1, the protruding elements 100 may be applied.

Figure 2H:
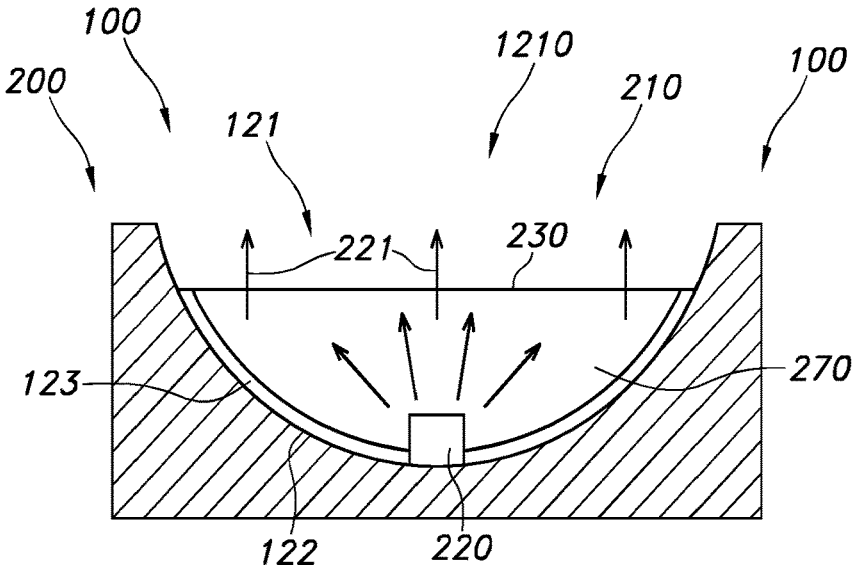

FIG. 2*h* schematically depicts in more detail a variant of e.g. the UV emitting unit 1210 with a curved cavity backside 122. Such curvature may be used to provide a good distribution of the UV radiation 221 over the UV radiation escape surface. Optionally, the cavity back side 122 may also include an UV reflective coating 123.

Figure 2I:
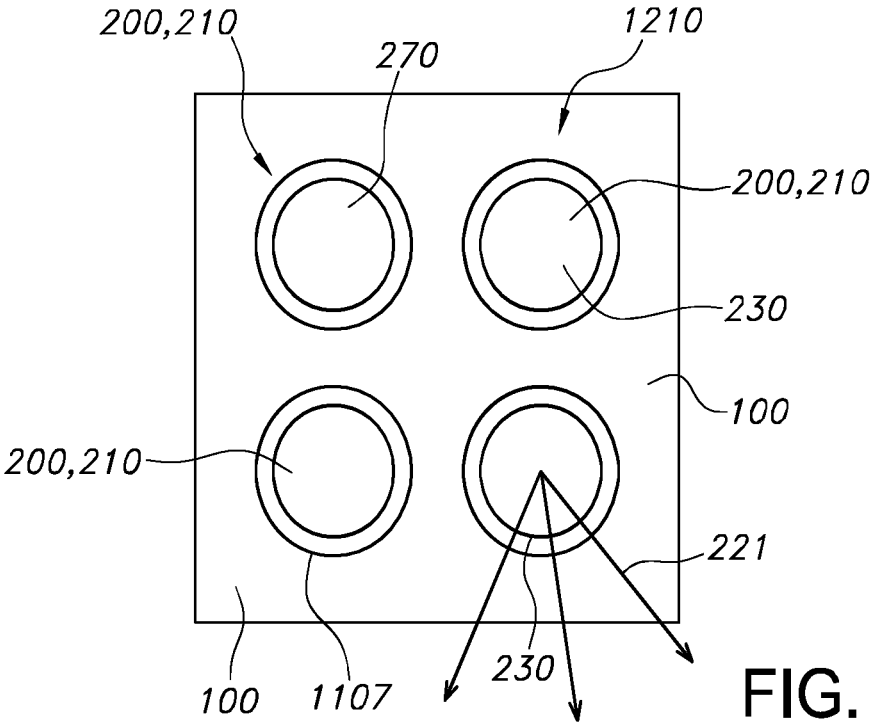

FIG. 2*i* schematically depicts a kind of negative of FIG. 2*d*. Here, a unit is provided which can be used as a protruding element, with a recession 1107 for hosting the light source, or especially the UV emitting element 210, or the optical medium 270, or the entire anti-biofouling system 200. Here, by way of example the recession or indentation 1107 is round. However, also other shapes, including square or rectangular may be used. Further, the configuration may be differently "packed" like a hexagonal configuration, etc. Such unit may be as a whole be attached to an external surface of an object. Note that thereby the surface of the unit may become (at least part of the) external surface of the object.

Figure 2J:
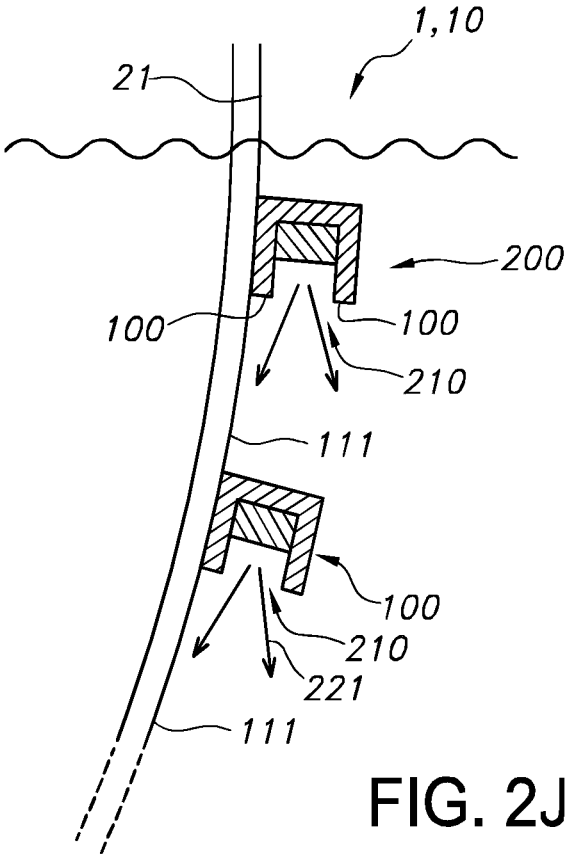

In an embodiment, at least part of the anti-bio fouling system, such as UV emitting element, could be arranged underneath a protruding element. That is, the protruding element might e.g. be a hollow steel strip, with UV emitting element inside/embedded. For instance, the protruding element anti-bio fouling system or UV emitting element, could be made in a factory, and installed as an add-on strip, directly on the original external surface of the object, such as a steel hull, see e.g. FIG. 2*j*

As indicated above, ships hulls are often damaged due to mechanical impact of fenders or the harbor quay, objects floating in the water, tugs, petrol supply ships etc. (see illustration in FIG. 2*c*). The mechanical damage is concentrated along the load line (see FIG. 2*c*/2*g*, ref. LL): ca 2 meter above till 2 meter below. Herein, this area will be indicated with "boot top". It is also an area exposed to both seawater and sunshine, making the environment harsh.

The waterline can vary of course depending on the load of the ship but is normally close to the load line indicated on the ship. Herein, a UV based antifouling construction to keep the hull of ships clean is suggested. Amongst others, this idea describes a solution to protect this construction against mechanical stress. It may only need to be applied at the boot top.

For new build ships the steel hull plate could be rolled in the curve shape. In case of existing ships, with the solution as defined herein, added afterwards, a steel profile can be attached to the ship. The curved surface can be coated with a highly UV reflective material, such as paint containing $BaO_2$ or other reflective ingredients. The vertical curve should be optimized to generate sufficient spread of the UV light. This could be a parabolic form with the light source in de focus point. The light source can e.g. be a quartz fiber with light originating from a UV laser and/or a string of UV LED's. The sizes of the profile and distance between the LED's will depend on the power emitted per $cm^2$. To be effective as antifouling the optical power leaving the radiation escape surface should especially be above 1 $mW/dm^2$ The UV light source may be embedded in a UV transparent material, such as silicone. The steel profile stands out more than the transparent material, thus giving mechanical protection, but limited to a few millimeters to ensure the UV light keeps the steel rim clean as well. The material and the light source, including wiring can be attached to the profile before the solution is added to the ship, being manufactured under factory conditions. Instead of a curved surface other shapes are possible, e.g. in FIGS. 2*a* (II) and 2*b* (II) the same idea is drawn with a T shaped profile. This has the advantage the light source can be protected even further by placing it in the corner. Other embodiments may be based on the addition of bumpers made of steel, tough silicon or glass may also be possible (see FIGS. 2*d*-2*e*).

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

The invention claimed is:

1. An object comprising:

an anti-biofouling system, wherein the anti-biofouling system comprises an UV emitting element; and protruding elements, wherein the UV emitting element is configured between the protruding elements, wherein the UV emitting element is configured depressed relative to the protruding elements, wherein the UV emitting element is configured to irradiate with UV radiation during an irradiation stage one or more of, a portion of an external surface of the object and water adjacent to the portion of the external surface of the object.

2. The object according to claim 1, wherein the UV emitting element comprises an optical medium, wherein the optical medium is configured to provide the UV radiation of a light source to the one or more of the portion of the external surface of the object and water adjacent to the portion of the external surface of the object, wherein the optical medium is configured between the protruding elements, wherein the optical medium is configured depressed relative to the protruding elements.

3. The object according to claim 2, wherein the optical medium comprises one or more of the light sources, wherein the one or more light sources comprise solid state light sources, wherein the optical medium comprises silicone.

4. The object according to claim 1, wherein the external surface comprises the protruding elements.

5. The object according to claim 1, further comprising a surface profile, wherein the surface profile comprises the protruding elements, wherein the surface profile is attached to the external surface, wherein the anti-biofouling system comprises the protruding elements.

6. The object according to claim 5, further comprising an UV emitting unit, wherein the UV emitting unit comprises the surface profile and an optical medium, wherein the surface profile is attached to the external surface.

7. The object according to claim 6, wherein the optical medium is configured to provide UV radiation from of a light source to a radiation escape surface of the optical medium, wherein the optical medium is configured between the protruding elements, wherein the optical medium is configured depressed relative to the protruding elements, wherein the radiation escape surface of the anti-biofouling system is configured as part of the external surface.

8. The object according to claim 1, wherein the protruding elements comprise steel, wherein the protruding elements are configured as protruding rims, wherein the UV emitting element is configured between the protruding rims.

9. The object according to claim 1, wherein the UV emitting element comprises a light source, wherein the light source has two or more nearest neighboring protruding elements, wherein a first shortest distance between a first nearest neighboring protruding element and the light source is equal to or less than 50% of a second shortest distance between a second nearest neighboring protruding element and the light source, wherein a smallest height difference between the protruding elements and the UV emitting element is at least 1 mm.

10. The object according to claim 1, wherein the object comprises a vessel, wherein the external surface comprises a steel hull.

* * * * *